US005310148A

United States Patent [19]

Dorr

[11] Patent Number: 5,310,148

[45] Date of Patent: May 10, 1994

[54] CLOSET POLE AND SHELF SUPPORT BRACKET

[76] Inventor: Richard Dorr, 434 Oak Lake Ave., Santa Rosa, Calif. 95409

[21] Appl. No.: 980,278

[22] Filed: Nov. 23, 1992

[51] Int. Cl.[5] ..... A47B 96/06

[52] U.S. Cl. ..... 248/223.4; 248/247

[58] Field of Search ..... 248/247, 248, 200.1, 248/223.4, 261

[56] References Cited

U.S. PATENT DOCUMENTS

| | | | |
|---|---|---|---|
| 177,471 | 5/1876 | Clark | 248/223.4 |
| 565,525 | 8/1896 | Tucker | 248/223.4 |
| 683,248 | 9/1901 | Chase | 248/223.4 |
| 1,254,170 | 1/1918 | Taussig | 248/247 |
| 1,599,653 | 9/1926 | Cranston | 248/223.4 |
| 2,477,771 | 8/1949 | Sanford | 248/247 |
| 2,720,373 | 10/1955 | Bell | 248/262 |
| 3,113,678 | 12/1963 | Dickinson et al. | 248/247 |
| 3,149,811 | 9/1964 | Frenstad et al. | 248/261 |
| 4,799,643 | 1/1989 | Shepard | 248/247 |

*Primary Examiner*—Scott Smith
*Attorney, Agent, or Firm*—Larry D. Johnson

[57] ABSTRACT

A closet pole and shelf support bracket includes a bracket back plate portion for securing to a closet wall, a bracket body portion having a first (back) edge releasably secured to the back plate, a second (top) edge defining a shelf support surface, and a third (front) edge, and a closet pole support element releasably secured to the bracket body front edge. The closet pole support element may be in the form of a support hook (for medial support of the pole) or a left or right rosette (for terminal support of the pole).

1 Claim, 3 Drawing Sheets

CLOSET POLE AND SHELF SUPPORT BRACKET

BACKGROUND OF THE INVENTION

1. Field of the Invention

This invention relates generally to building materials and home construction hardware, and more specifically to an improved bracket structure for closet pole and closet shelf support.

2. Description of the Prior Art

Storage closets typically include a horizontal closet pole or rod to enable hanging of garments from clothes hangers. Traditional closet pole support brackets simply provide a bracket body which is secured by nails or screws to the wall of the closet, and terminating in a fixed hook portion into which the closet pole may be rested, with the ends of the closet pole captured in and supported by separate rosettes secured to the closet walls. Such traditional brackets are often difficult to install and remove, and to align with the corresponding rosettes on opposing walls.

SUMMARY OF THE INVENTION

The closet pole and shelf support bracket of this invention provides a versatile structure for closet pole and closet shelf support. The novel bracket includes a bracket back plate portion for securing by nails or screws to a closet wall, a bracket body portion having a first (back) edge bearing means for releasable securing to the back plate, a second (top) edge defining a shelf support surface, and a third (front) edge, and a closet pole support element bearing means for releasable securing to the bracket body front edge. The closet pole support element may be in the form of a support hook (for medial support of the pole) or a left hand or right hand rosette (for terminal support of the pole). The bracket body and back plate are preferably releasably secured to one another by complementary track and channel elements, dove-tail and groove elements, or equivalent fastening methods. Similarly, the bracket body and closet pole support elements are preferably releasably secured to one another in such a fashion.

Thus, the closet pole and shelf support bracket of this invention can be installed as original or replacement hardware in new or existing construction. The interchangeability of the closet pole support elements enables the bulk of the assembly (the back plate and bracket body portions) to be mass-produced, thereby realizing savings in labor and materials.

DETAILED DESCRIPTION OF A PREFERRED EMBODIMENT

Figure 1:
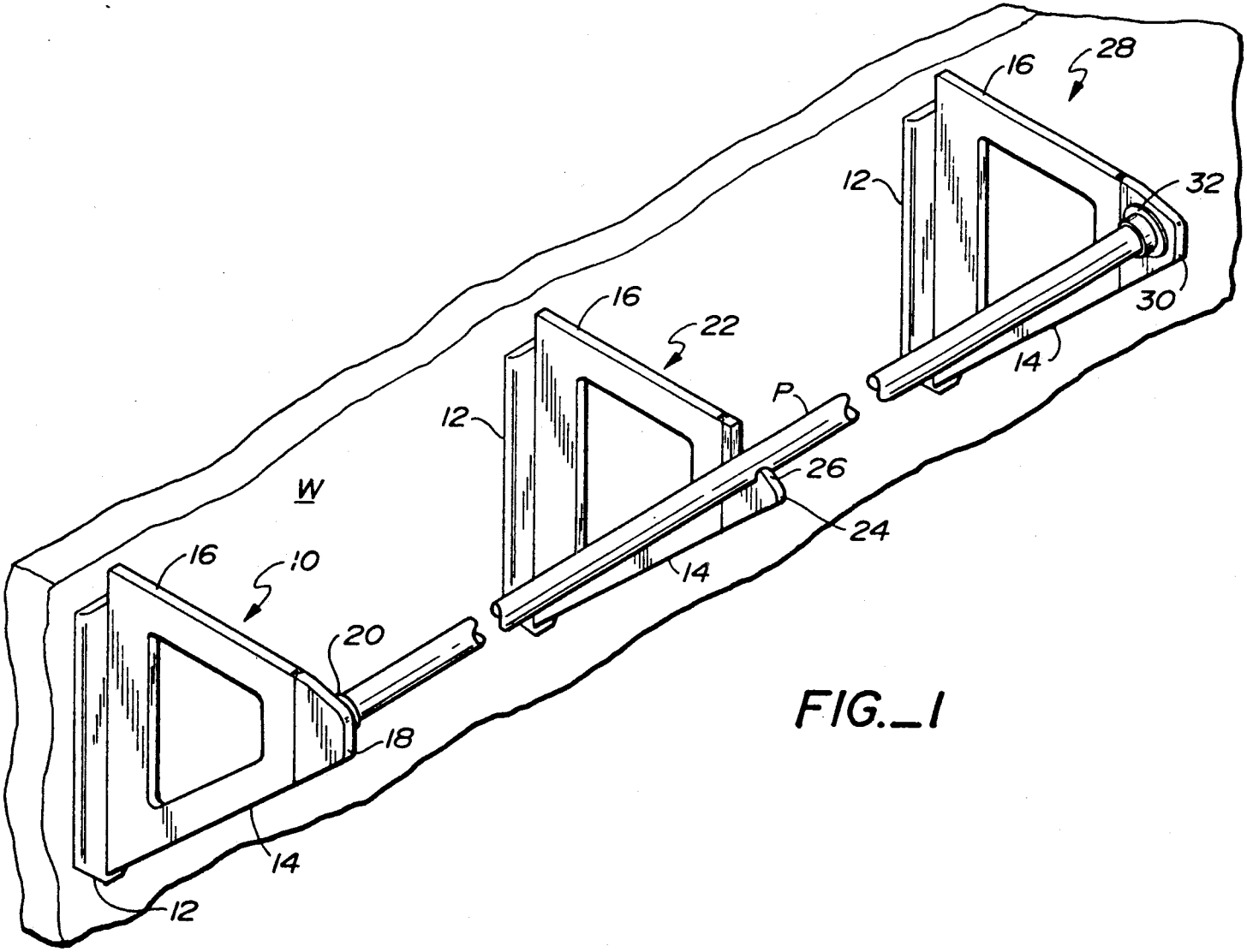
FIG. 1 is a partially fragmented perspective view of a series of closet pole and shelf support bracket assemblies of this invention as installed on a typical closet wall and supporting a closet pole, illustrating a left side bracket assembly including a bracket back plate portion, a bracket body portion with a shelf support surface (shelf not shown), and a closet pole terminal support element in the form of a left hand rosette; a central bracket assembly including a bracket back plate portion, a bracket body portion with a shelf support surface, and a closet pole medial support element in the form of a closet pole support hook; and a right side bracket assembly including a bracket back plate portion, a bracket body portion with a shelf support surface, and a closet pole terminal support element in the form of a right hand rosette.

FIG. 1 is a partially fragmented perspective view of a series of closet pole and shelf support bracket assemblies of this invention as installed on a typical closet wall W and supporting a closet pole P. This view illustrates a left side bracket assembly 10, including a bracket back plate portion 12, a bracket body portion 14 with a shelf support surface 16 (shelf not shown), and a closet pole terminal support element 18 in the form of a left hand rosette 20; a central bracket assembly 22 including a bracket back plate portion 12, a bracket body portion 14 with a shelf support surface 16, and a closet pole medial support element 24 in the form of a closet pole support hook 26; and a right side bracket assembly 28 including a bracket back plate portion 12, a bracket body portion 14 with a shelf support surface 16, and a closet pole terminal support element 30 in the form of a right hand rosette 32.

Figure 2:
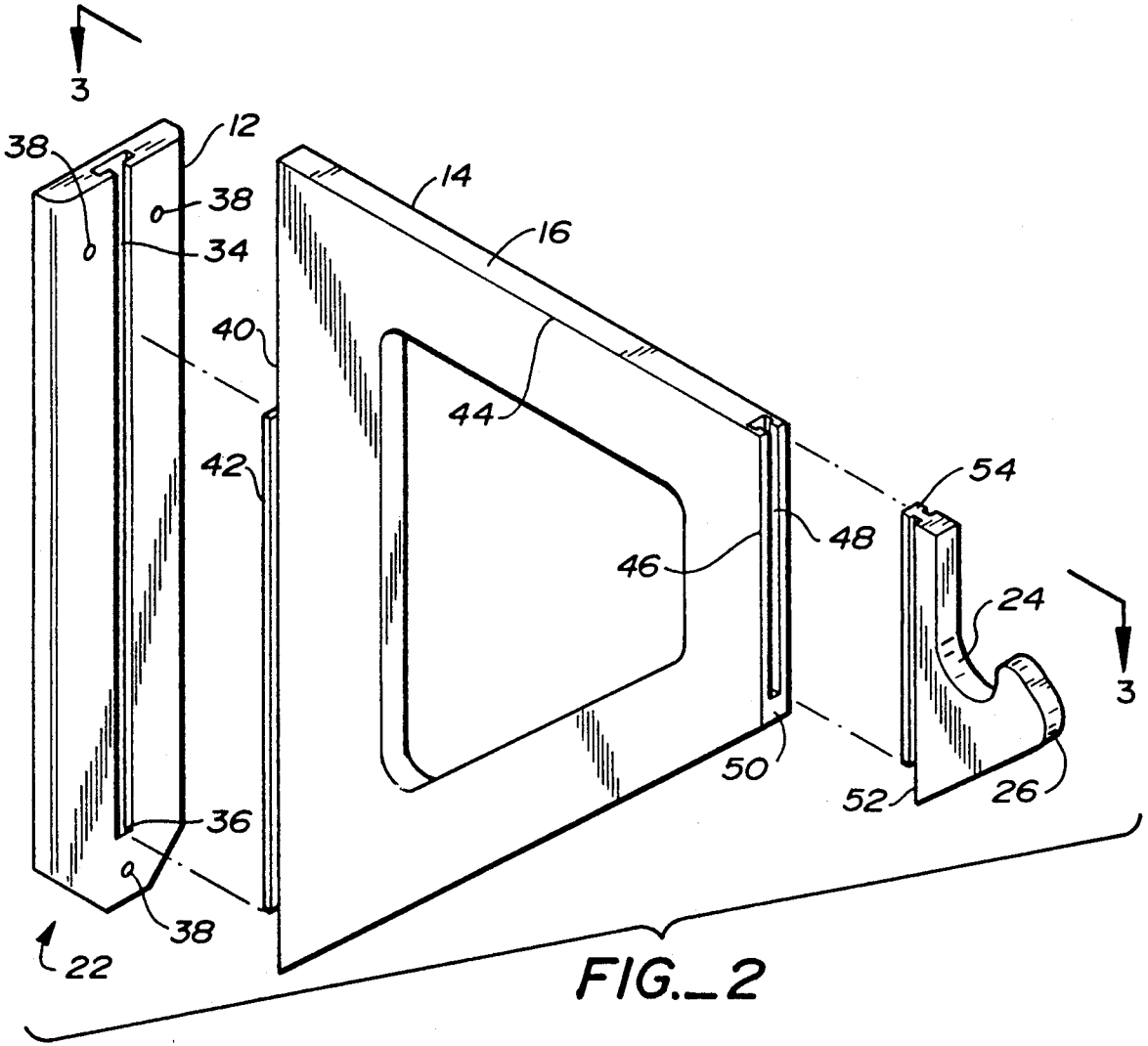
FIG. 2 is an exploded perspective view of a central bracket assembly of the closet pole and shelf support bracket of this invention, illustrating the component parts including the wall mounted back plate portion bearing a vertical receiving channel and a plurality of screw holes; a generally truncated-triangular bracket body portion having a first edge bearing a vertical track element complementary to said back plate receiving channel, a second edge bearing a shelf support surface, and a third edge bearing a vertical receiving channel; and a closet pole medial support element including a closet pole support hook and an edge bearing a vertical track element complementary to said bracket body third edge receiving channel.

FIG. 2 is an exploded perspective view of a central bracket assembly 22 of the closet pole and shelf support bracket of this invention, illustrating the component parts including the wall mounted back plate portion 12 bearing a vertical receiving channel 23, channel base 36, and a plurality of pre-drilled screw holes 38. Back plate 12 may be made in any size, e.g., twelve to thirteen inches long and two and one-quarter inches wide, and may include slightly angled (e.g., approximately eight degrees) screw holes to better converge on a standard wall stud. The assembly further includes a generally truncated-triangular bracket body portion 14 having a first edge 40 bearing a vertical track element 42 complementary to said back plate 12 receiving channel 34, a second edge 44 bearing a shelf support surface 16, and a third edge 46 bearing a vertical receiving channel 48 and channel base 50. A closet pole medial support element 24 includes a closet pole support hook 26 and an edge 52 bearing a vertical track element 54 complementary to said bracket body third edge receiving channel 48.

The overall assembly may be approximately twelve and one-half inches deep, corresponding to typical closet pole installation dimensions. The component parts may be made of plastic, particle board, wood or any other suitable material.

Figure 3:
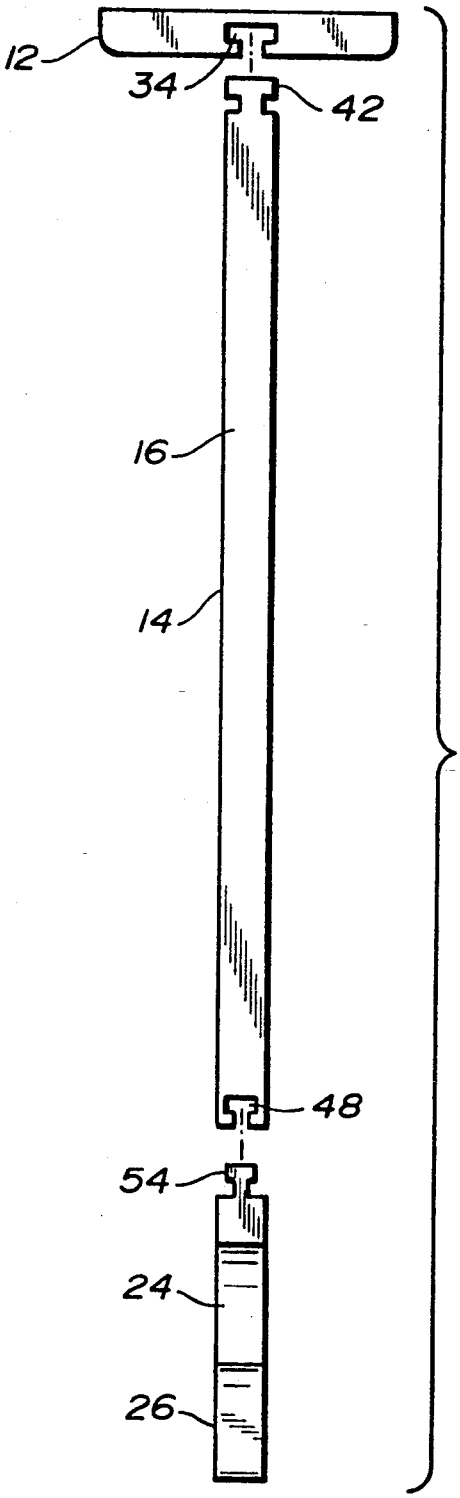
FIG. 3 is an exploded top plan view of the central bracket assembly of the closet pole and shelf support bracket of FIG. 2, this view taken along line 3—3 of FIG. 2.

FIG. 3 is an exploded top plan view of the central bracket assembly 22 of the closet pole and shelf support bracket of FIG. 2, this view taken along line 3—3 of FIG. 2. The T-type track and channel illustrated is suitable for many materials, such as plastic. If the inventive bracket assembly is constructed of wood, a traditional dove-tail and groove may be more appropriate.

Figure 4:
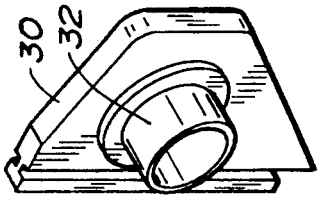
FIG. 4 is a perspective view of a closet pole terminal support element bearing a right side rosette, this piece being interchangeable with a terminal support element bearing a left side rosette, or a closet pole medial support element, on the bracket body.

FIG. 4 is a perspective view of a closet pole terminal support element 30 bearing a right side rosette 32, this piece being interchangeable with a terminal support element bearing a left side rosette, or a closet pole medial support element, on the bracket body. The rosette used may be a full rosette as illustrated, a partial (semicircular) rosette, or any other equivalent structure.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A closet pole and shelf support bracket comprising:

a bracket back plate portion for securing to a closet wall;

a bracket body portion having a first edge bearing means for releasable securing to said bracket back plate portion, a second edge defining a shelf support surface, and a third edge; said means for releasably securing said bracket body portion first edge to said bracket back plate portion comprises complementary track and channel elements; and a closet pole support element including a closet pole support hook member, said closet pole support element bearing means for releasable securing to said bracket body portion third edge; said means for releasably securing said closet pole support element to said bracket body portion third edge comprises complementary track and channel elements.

* * * * *